US006769973B2

(12) United States Patent
Boo et al.

(10) Patent No.: US 6,769,973 B2
(45) Date of Patent: Aug. 3, 2004

(54) POLISHING HEAD OF CHEMICAL MECHANICAL POLISHING APPARATUS AND POLISHING METHOD USING THE SAME

(75) Inventors: Jae-Phil Boo, Suwon (KR); Jong-Soo Kim, Suwon (KR); Jun-Gyu Ryu, Seoul (KR); Sang-Seon Lee, Yongin-shi (KR); Sun-Wung Lee, Yongin-shi (KR)

(73) Assignee: Samsung Electronics Co., Ltd. (KR)

( * ) Notice: Subject to any disclaimer, the term of this patent is extended or adjusted under 35 U.S.C. 154(b) by 113 days.

(21) Appl. No.: 10/107,612

(22) Filed: Mar. 27, 2002

(65) Prior Publication Data

US 2003/0008604 A1 Jan. 9, 2003

Related U.S. Application Data

(63) Continuation-in-part of application No. 09/877,922, filed on Jun. 7, 2001.

(30) Foreign Application Priority Data

May 31, 2001 (KR) ..... 2001-30365

(51) Int. Cl.[7] ..... B24B 49/00

(52) U.S. Cl. ..... 451/289; 451/41; 451/285; 451/290; 451/398; 340/680

(58) Field of Search ..... 451/285–290, 451/388, 398, 41, 397; 279/3; 340/680

(56) References Cited

U.S. PATENT DOCUMENTS

| | | | | | |
|---|---|---|---|---|---|
| 5,916,015 | A | * | 6/1999 | Natalicio | 451/288 |
| 5,957,751 | A | * | 9/1999 | Govzman et al. | 451/8 |
| 6,033,292 | A | * | 3/2000 | Inaba | 451/288 |
| 6,036,587 | A | * | 3/2000 | Tolles et al. | 451/288 |
| 6,050,882 | A | * | 4/2000 | Chen | 451/41 |
| 6,273,803 | B1 | * | 8/2001 | Wang et al. | 451/288 |
| 6,273,804 | B1 | * | 8/2001 | Numoto | 451/288 |
| 6,277,000 | B1 | * | 8/2001 | Gotcher | 451/41 |
| 6,277,014 | B1 | * | 8/2001 | Chen et al. | 451/398 |
| 6,361,420 | B1 | * | 3/2002 | Zuniga et al. | 451/288 |
| 6,447,379 | B1 | * | 9/2002 | Gromko et al. | 451/287 |

* cited by examiner

*Primary Examiner*—Joseph J. Hail, III
*Assistant Examiner*—Anthony Ojini
(74) *Attorney, Agent, or Firm*—Mills & Onello, LLP

(57) ABSTRACT

A chemical mechanical polishing (CMP) apparatus includes a polishing head that is composed of a carrier and a membrane, and is positioned on a polishing pad of a supporting part. The polishing head has a supporter installed at an internal center of the carrier, a chucking ring positioned between the carrier and the supporter, and means for moving the chucking ring up and down in a vertical direction. The supporter forms a sealed space together with the membrane, and the chucking ring chucks the wafer in vacuum.

7 Claims, 16 Drawing Sheets

POLISHING HEAD OF CHEMICAL MECHANICAL POLISHING APPARATUS AND POLISHING METHOD USING THE SAME

RELATED APPLICATIONS

This application is a continuation-in-part application of U.S. patent application Ser. No. 09/877,922, filed Jun. 7, 2001, the contents of which are incorporated herein by reference, in their entirety.

This application relies for priority upon Korean Patent Application No. 2001-30365, filed on May 31, 2001, the contents of which are incorporated herein by reference, in their entirety.

FIELD OF THE INVENTION

The present invention generally relates to an apparatus and method for manufacturing a semiconductor wafer and, more particularly, to a chemical mechanical polishing (CMP) machine and related polishing method.

BACKGROUND OF THE INVENTION

As the elements incorporated into a semiconductor device are increasingly integrated, the structure of device wires such as gate lines and bit lines continues to become multiple-layered. For this reason, step coverage between unit cells on a semiconductor substrate is increased. To reduce the step coverage between the unit cells, various methods of polishing a wafer have been developed. Among these methods, a chemical-mechanical polishing (CMP) method, which planarizes a polished surface (processing surface) of the wafer during fabrication, is widely used.

In a general CMP process, a polishing head of a CMP apparatus secures a wafer using a vacuum or surface tension and loads the wafer on an abrasive pad of a turntable. The polishing head imposes a controllable load on the wafer to hold it in tight contact with the abrasive pad. Thereafter, the polishing head may be rotated to rotate the wafer with respect to the abrasive pad of the turntable.

In order to increase the efficiency of the CMP process, the wafer should be polished at a high speed while maintaining uniform flatness. However, characteristics such as uniformity, flatness and polishing speed of the wafer are highly dependent on relative speed between the wafer and the abrasive pad, as well as the force or load of the polishing head urging the wafer against the abrasive pad. Particularly, the larger the force imposed on the wafer by the polishing head against the abrasive pad, the faster the polishing speed. Accordingly, in the case where an uneven load is imposed on the wafer by means of the polishing head, a portion of the wafer on which relatively large force is imposed will be polished at a faster rate than other portions of the wafer on which relatively small force is imposed.

Generally, the polishing head includes a flexible membrane which is adapted to pick up and release the wafer by vacuum. However, the vacuum between the membrane and the wafer often times leaks, such that during transfer, the wafer may be dropped or otherwise harmed.

To address these limitations, a polishing head with a modified structure has been proposed, which chucks/releases a wafer via vacuum holes formed at bosses that protrude from a chucking supporter of the head. However, such a polishing head introduces limitations that are shown in FIG. 1, which is a graph illustrating the resulting uneven surface of a wafer. In FIG. 1, reference character A indicates a wafer portion corresponding to the protruded bosses and reference character B indicates a wafer portion corresponding to a step projected from an edge of the supporter. Portions A and B are relatively over-polished as compared to other portions of the wafer, thereby compromising the uniformity of polishing surface of the wafer.

Polishing uniformity in the CMP process depends highly upon the equipment used, particularly the structure of the polishing head. For this reason, the CMP industry has eagerly developed and applied membrane-type heads of a high polishing uniformity. Further, as the wafer caliber becomes larger, there is a high demand for equipment adapted for controlling the CMP polishing characteristics at regions near the edges of the wafer.

SUMMARY OF THE INVENTION

It is an object of the present invention to provide an improved polishing apparatus and method for polishing a semiconductor wafer with high polishing uniformity.

It is another object of the present invention to provide a polishing apparatus and method capable of variably controlling the pressure applied to regions of the wafer during the polishing process.

It is still another object of the present invention to provide a polishing apparatus and method capable of variably controlling the polishing speed at regions of the wafer during a polishing process.

It is yet another object of the present invention to provide a polishing apparatus having a head capable of stably securing a wafer.

In one aspect, the present invention is directed to an apparatus for polishing a wafer. The apparatus includes a base having a polishing pad; and a polishing head comprising a carrier and a membrane, the polishing head positioned over the polishing pad of the base. The polishing head includes: a supporter at an internal portion of the carrier forming a sealed region together with the membrane. A chucking ring vacuum-chucks a wafer, the chucking ring being positioned between the carrier and the supporter. Means are provided for moving the chucking ring in a vertical direction relative to the supporter.

The means for moving is preferably positioned between the carrier and the chucking ring, and includes an elastic member which is expanded by an externally provided pressure to move the chucking ring in the vertical direction. An external surface of the chucking ring is preferably covered by the membrane.

The membrane may be divided into first and second regions each enclosing sealed volumes together with the carrier, and an internal pressure of each respective first and second region is independently controlled relative to the other. The first region is preferably positioned at a center of the membrane, and the second region is positioned about the first region. The first region has a first width that is smaller than a second width of the second region.

The membrane preferably has a vacuum hole for chucking/releasing a wafer and a partition wall for dividing the membrane into first and second regions. The vacuum hole can be formed at the first region of the membrane, or the second region of the membrane.

In another aspect, the present invention is directed to an apparatus for polishing a wafer. The apparatus includes a base having a polishing pad. A polishing head comprises a carrier and a membrane communicating with the carrier so as to form first and second regions. The polishing head positioned over the polishing pad of the base. The polishing head includes a supporter at an internal central region of the carrier to provide a first chamber corresponding to the first region, and a chucking ring about the supporter in the carrier and collinear with the supporter to provide a second chamber corresponding to the second region. The membrane covers the supporter and the chucking ring.

The first chamber communicates with a first fluid passage and wherein the second chamber communicates with a second fluid passage. The supporter includes first outlets for connecting the first chamber to the first region, and the chucking ring has second outlets for connecting the second chamber to the second region.

The membrane includes vacuum holes for chucking/releasing a wafer, the vacuum holes corresponding to the second outlets of the chucking ring. The first region comprises an annular region about the center of the membrane, and the second region is positioned about the first region. A central region may be positioned within the annular first region, and the internal pressure of the central region is preferably independent of internal pressure of the first and second regions. The membrane divided into the first and second regions is preferably annular.

In another aspect, the present invention is directed to a method for polishing a wafer. A wafer is drawn by vacuum through a vacuum hole of a membrane positioned under a polishing head. The vacuum-absorbed wafer is located on a polishing pad. A fluid is injected through first and second fluid ports of a carrier on the polishing head to expand first and second independent regions of a membrane positioned under the polishing head. First and second independent pressures are thereby applied to the wafer. The polishing pad is then rotated to polish the wafer.

The fluid is preferably independently injected into the first and second fluid ports to independently apply the first and second pressures to first and second regions of the membrane. The carrier is preferably concave, and the support is at a concave interior of the carrier, and the carrier preferably includes first and second chambers and first and second chamber ports in order to uniformly and independently pass injected fluid to the first and second regions, whereby a uniform pressure is applied to the membrane during polishing.

In another aspect, the present invention is directed to a method for polishing a wafer. A vacuum is formed at a chucking ring positioned under a polishing head communicating with a first fluid port in the polishing head to position the wafer on a polishing pad. A fluid is injected into first and second fluid ports to expand first and second regions of a membrane positioned under the polishing head for applying first and second independent pressures to the wafer. The polishing pad is then rotated to polish the wafer.

The membrane may be positioned at a central portion of the polishing head, and the chucking ring may be located at an exterior of the membrane. The chucking ring can be moved in a downward vertical direction to apply a load to an edge of the wafer during the step of applying the first and second pressures to the wafer. The chucking ring is moved in the vertical direction by a pressure applied to an elastic member positioned between the carrier and the chucking ring. The chucking ring may be covered with the membrane.

In another aspect, the present invention is directed to an apparatus for polishing a wafer. A supporting portion has an abrasive pad disposed thereon. A polishing head is disposed over said abrasive pad. The polishing head comprises a carrier and at least two membranes dividing the carrier to form at least two independent chambers. A retaining ring is disposed on an edge of the polishing head. A chucking ring is disposed on a lower portion of the polishing head, wherein one of said at least two membranes encloses an outer portion of the chucking ring.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

The present invention will now be described more fully hereinafter with reference to the accompanying drawings, in which preferred embodiments of the invention are shown. Like numbers refer to like elements throughout.

[First Embodiment]

Figure 1:
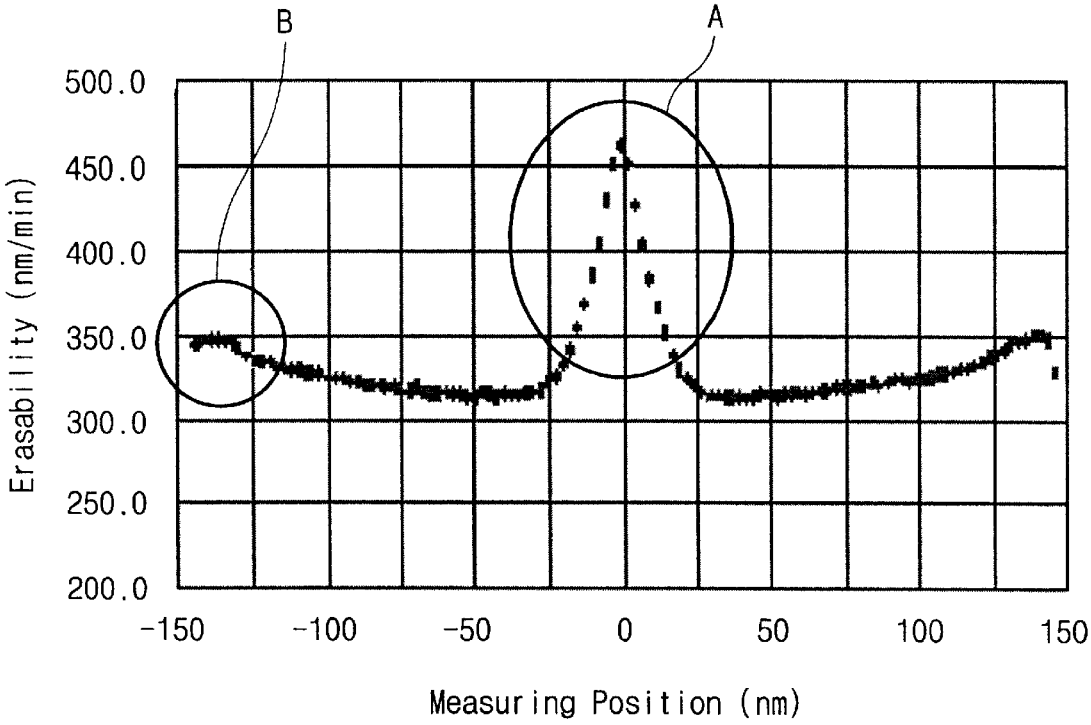
FIG. 1 is a graph illustrating a non-uniform polishing state of a wafer.
Figure 2:
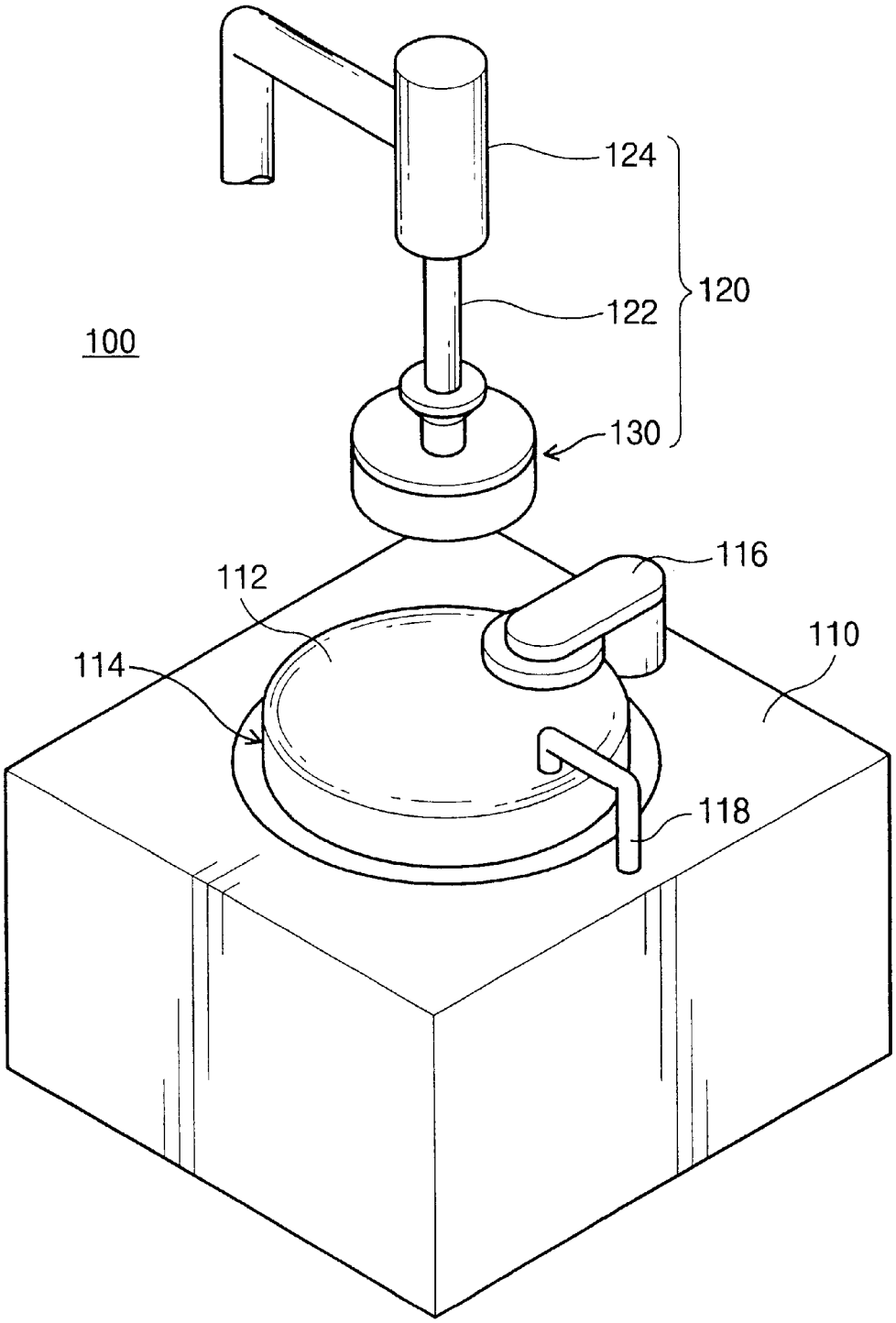
FIG. 2 is an exploded perspective view of a CMP apparatus according to a preferred embodiment of the present invention.

Referring now to FIG. 2, a general apparatus for CMP 100 to which the present invention is applicable includes a polishing station 110 and a polishing head assembly 120.

On the polishing station 110, a rotatable turntable 114 is connected with a device (not shown) for rotating the turntable is disposed. During a polishing process, the rotating device is rotated at about 50 to 80 RPM (revolutions per minute). The rotatable turntable 114 has an abrasive pad 112 mounted thereon. The abrasive pad 112 is composed of a circle-shaped plate of composite material having an uneven polishing surface.

The polishing station 110 includes a device 116 for conditioning the abrasive pad 112 and a device 118 for supplying slurries on the surface of the abrasive pad 112. The slurries are composed, for example, of a reaction reagent such as deionized water (DIW) for oxidation polishing, abrasive particles such as silicon dioxide for oxidation polishing, and a chemical reaction catalyst such as potassium hydroxide for oxidation polishing. It is noted that since the conditioning device 116 and the slurry supplying device 118 are devices well-known in the art and not within the scope of the invention, they will not be explained in detail in the present application.

The polishing head assembly 120 of the apparatus for CMP 100 includes a polishing head 130, a driving shaft 122 and a motor 124. The polishing head 130 functions to uniformly impose a downward pressure on a wafer 10 and maintain the wafer 10 in contact with the abrasive pad 112. The polishing head 130 can be rotated at 40 to 70 RPM by means of the driving shaft 122 coupled to the motor 124. The polishing head 130 is also connected to two fluid channels, each of which is coupled to a pump in order to supply air for pushing the wafer 10 or vacuum for capturing and holding the wafer 10.

Figure 3:
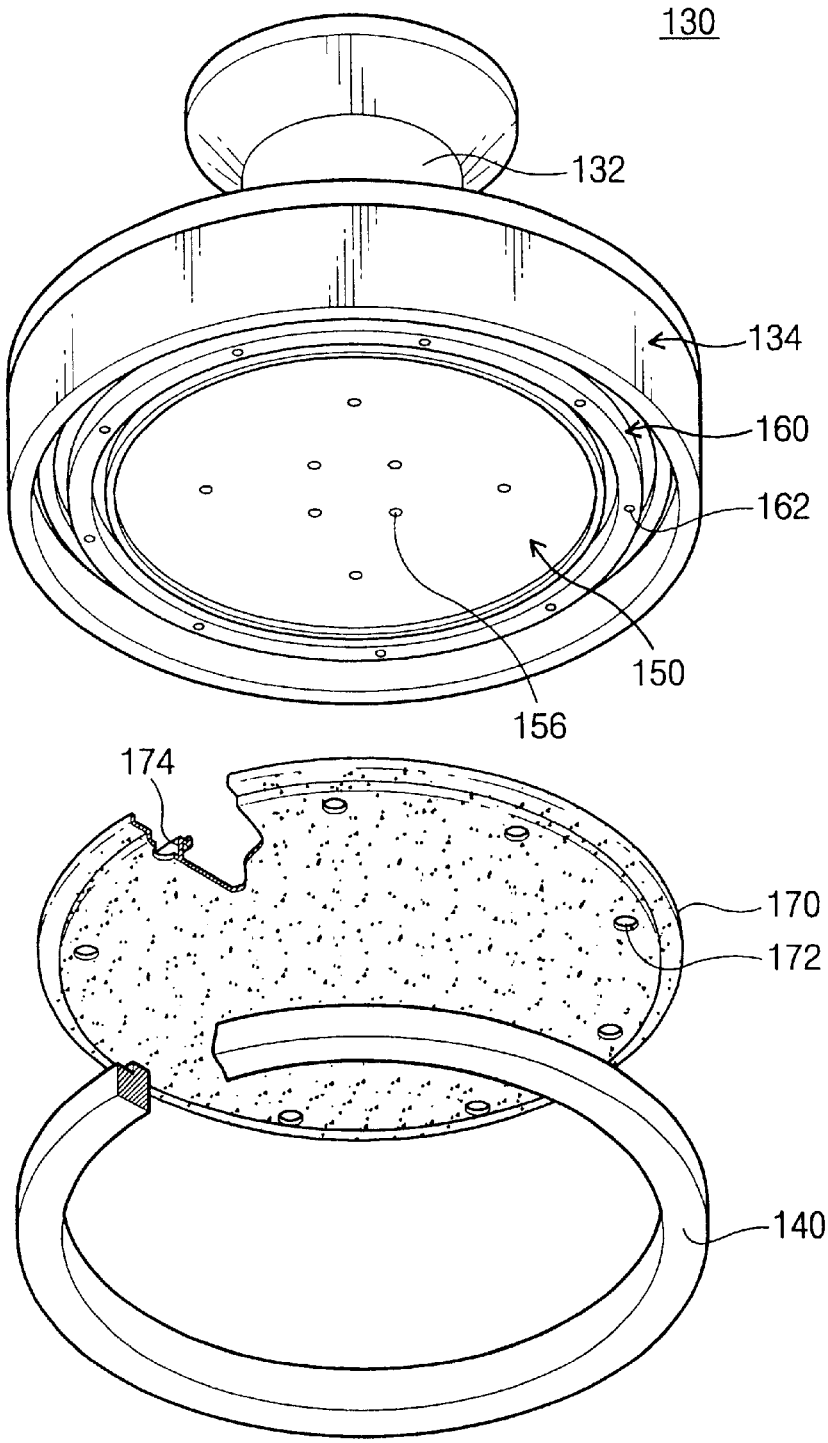
FIG. 3 is an exploded perspective view of a polishing head according to a preferred embodiment of the present invention.
Figure 4:
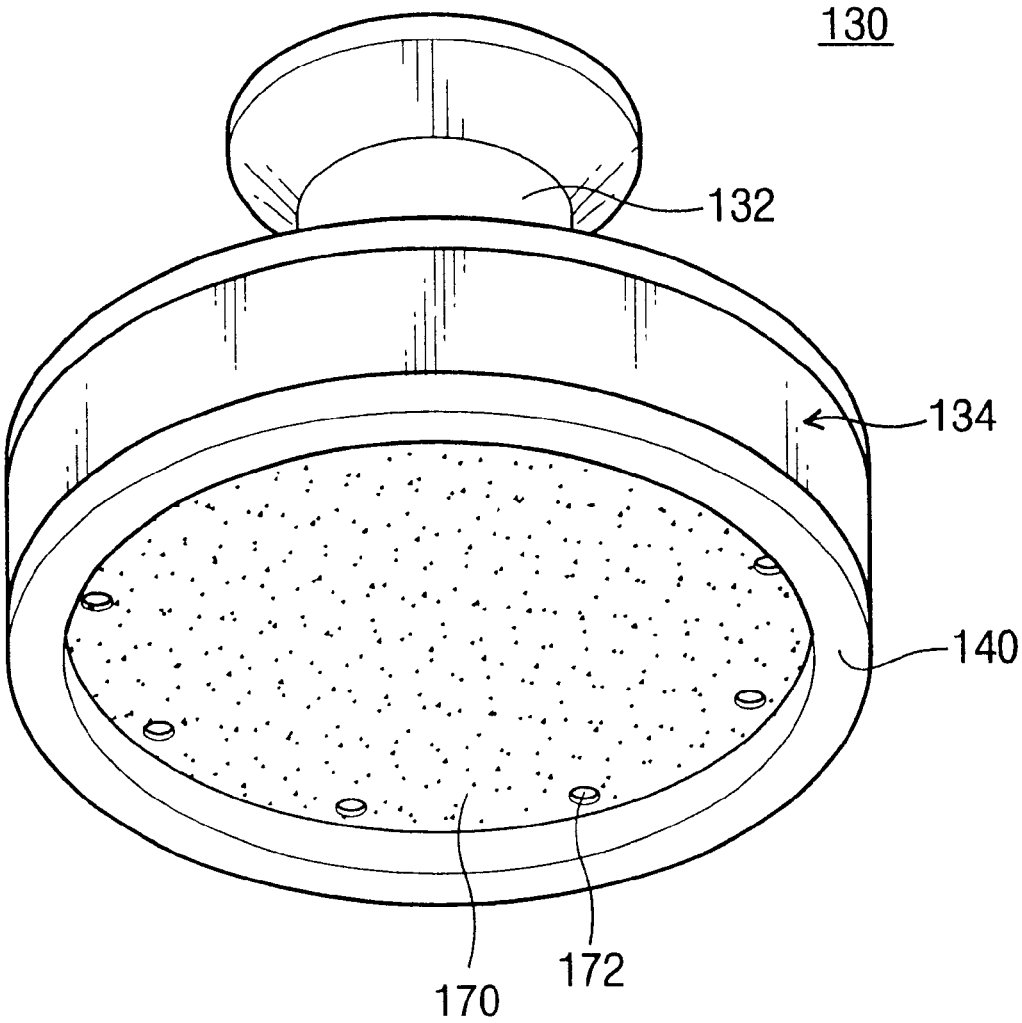
FIG. 4 is an exterior view of a polishing head shown in FIG. 3.
Figure 5A:
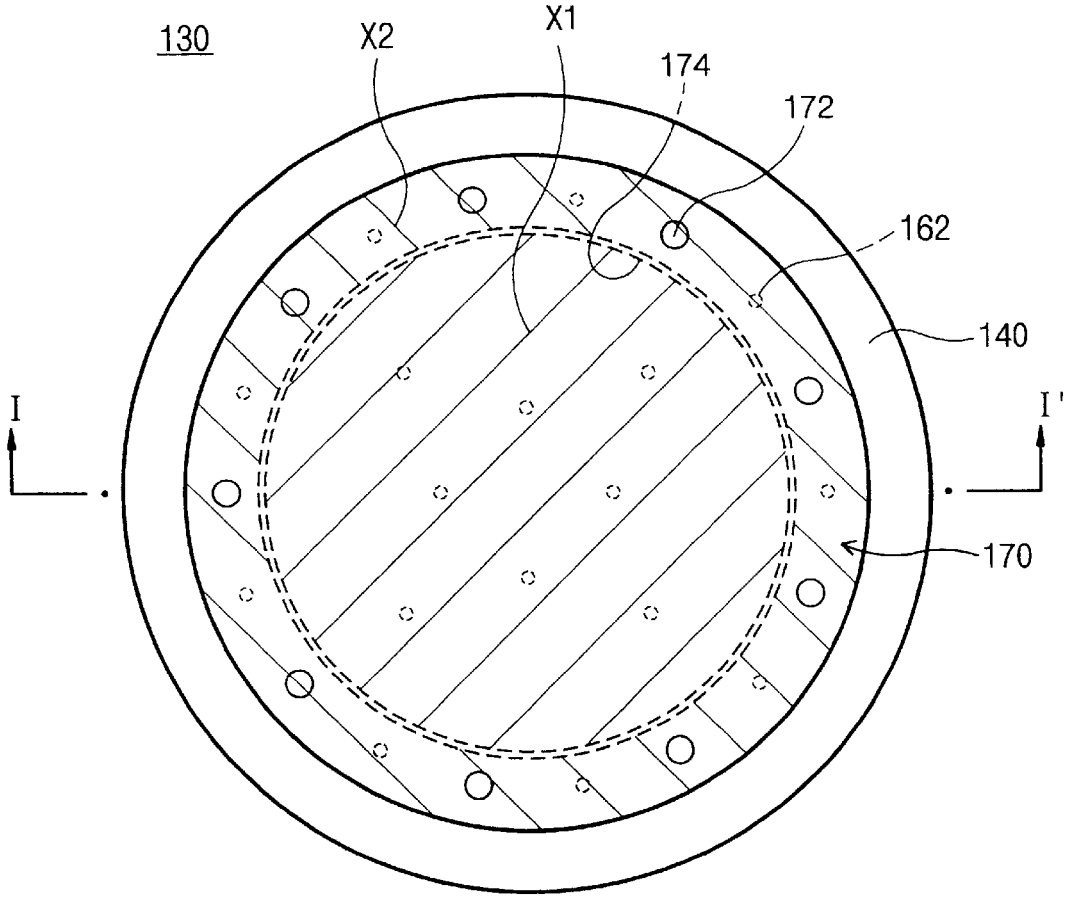
FIG. 5A is a bottom view of a polishing head shown in FIG. 3.
Figure 5B:
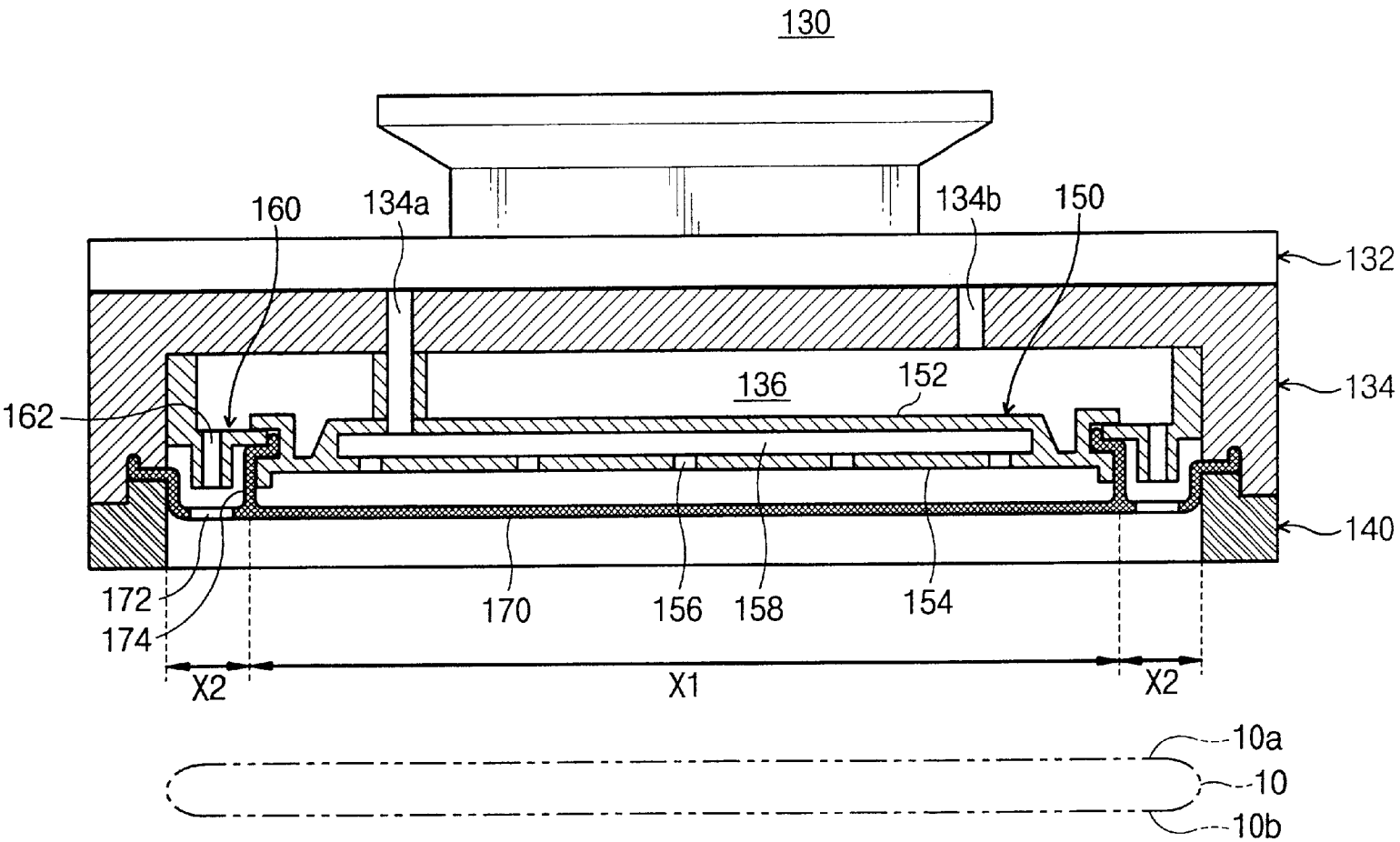
FIG. 5B is a cross-sectional view of a polishing head, taken along a line I–I' shown in FIG. 5A.

With reference to FIG. 3 and FIG. 5B, a polishing head 130 will now be described more fully in detail. The polishing head 130 includes a manifold 132, a dish-shaped carrier 134, a retaining ring 140, a supporter 150, a chucking ring 160, and a flexible membrane 170. The assembled polishing head is illustrated in perspective in FIG. 4, and the underside of the assembled polishing head is illustrated in FIG. 5A.

The manifold 132 is a component for dispersing two fluid providing channels to first and second fluid passages, or gas gates 134*a* and 134*b*.

The supporter 150 is installed in the carrier 134, and has an upper side 152, a bottom side 154, a plurality of first holes 156, and a first chamber 158. The first chamber 158 communicates with the first gas gate 134*a*, and the first holes 156 communicate with a first region X1 of the membrane 170.

The chucking ring 160 provides a second chamber 136 that communicates with the second gas gate 134*b* together with an inner side of the carrier 134 and the upper side 152 of the supporter 150. The second chamber 136 communicates with a second space X2 of the membrane 170 through a plurality of second holes 162.

The membrane 170 applies a load to a thin rubber film that is in direct contact with a rear surface 10*a* of the wafer 10. When the membrane 170 is expanded under pressure, it applies a load to the rear surface 10*a* of the wafer 10. The membrane 170 is divided into first and second regions X1 and X2 that enclose sealed volumes together with the supporter 150 and the chucking ring 160, respectively. Vacuum and pressure for the sealed first and second regions X1 and X2 are independently controlled with respect to each other. The first region X1 is positioned at a center of the membrane 170, and the second region X2 is positioned to cover the first region X1. The width of the second regions X2 is larger than that of the first region X1.

Since the chucking ring 160 is covered by the membrane 170, a pressure provided to the second region X2 is not discharged to the exterior. Therefore, it is possible to impart a load on a wafer corresponding to the provided pressure. As a result, wafer uniformity during the CMP process can be increased.

The membrane 170 includes vacuum holes 172 and a partition wall 174 for dividing the membrane into first and second parts. Note that the vacuum hole 172 may be formed at the first region X1 of the membrane 170 or at the first and second regions X1, X2. The vacuum hole 172 may be formed collinearly with the second hole 162 of the chucking ring 160.

In the CMP apparatus according to the present invention, an AMAT (Applied Material) membrane of 40 duro is preferably used. The elasticity of the membrane has an influence upon polishing uniformity. For example, if the elasticity is high, a central portion of a wafer receives a relatively higher pressure than an edge part of the wafer. Therefore, the resulting polishing ratio becomes higher at the central portion. Since higher pressure tends to be applied not only to the central portion but also to lateral portions in the present invention, the wafer polishing ratio can be increased. Note that the elasticity of the membrane is controlled by the thickness and type of material employed, and the thickness and type of material can be locally controlled to improve the wafer polishing ratio.

A retaining ring 140 is installed at a lower edge of the carrier 134. The retainer ring 140 operates to prevent the wafer 10 from separating from the polishing head 130 during polishing.

A wafer polishing process of an apparatus for CMP 100 having a polishing head 130 in accordance with the first embodiment of the present invention will now be described. The polishing process comprises the steps of loading a wafer 10 on an abrasive pad 112 of a turntable 114 by means of a polishing head 130, polishing the front surface 10*b* of the wafer 10 by applying an air pressure on first and second regions X1, X2 of the membrane 170, chucking the wafer 10 by vacuum capture at the polishing head 130, and unloading the wafer 10 on a stand-by stage (not shown) from the abrasive pad 112 of the turntable 114.

The steps of the polishing process are now described more fully with reference to the following table.

TABLE 1

| | First Chamber | Second Chamber |
|---|---|---|
| Loading | vacuum | vacuum |
| Polishing | pressure | pressure |
| Chucking | vacuum or zero | vacuum |
| Unloading | pressure | pressure or zero (preferably, pressure) |

Figure 6A:
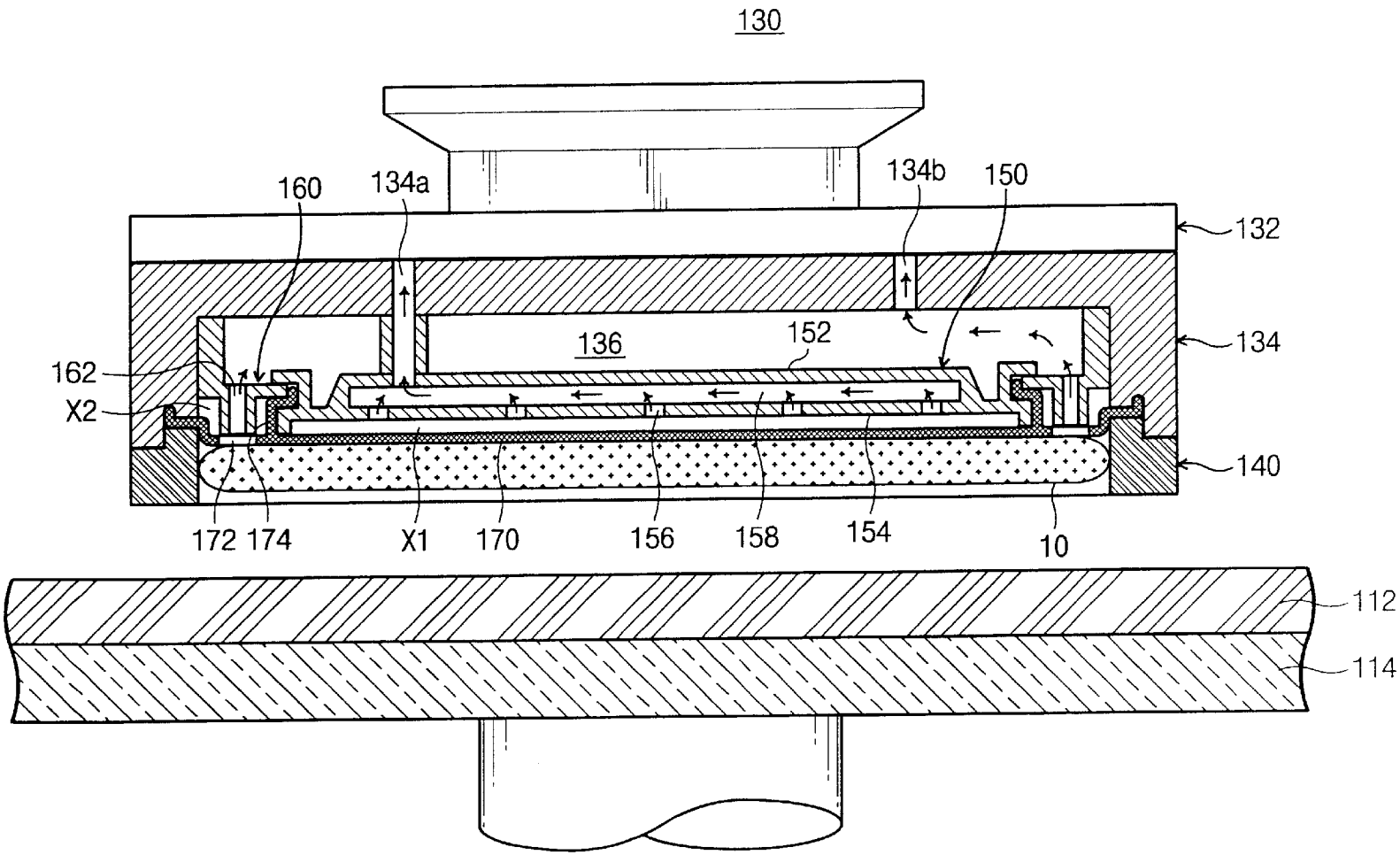
FIG. 6A through FIG. 6C are cross-sectional views for illustrating the polishing steps in a CMPO apparatus according to a first embodiment of the present invention.

In the loading step, the polishing head 130 is moved to bring the membrane 170 into position on the wafer rear surface 10*a*, as shown in FIG. 6A. A vacuum is drawn in the first chamber 158 through the first gas gate 134*a*, and is also drawn in the second chamber 136 through the second gas gate 134*b*. As a result, the wafer 10 is stably vacuum-absorbed to vacuum holes 172 of the membrane 170. The stably absorbed wafer 10 is next loaded on the polishing pad 112 of the turntable 114. The polishing head 130 descends until the wafer 10 contacts with the polishing pad 112, as shown in FIG. 6B.

Figure 6B:
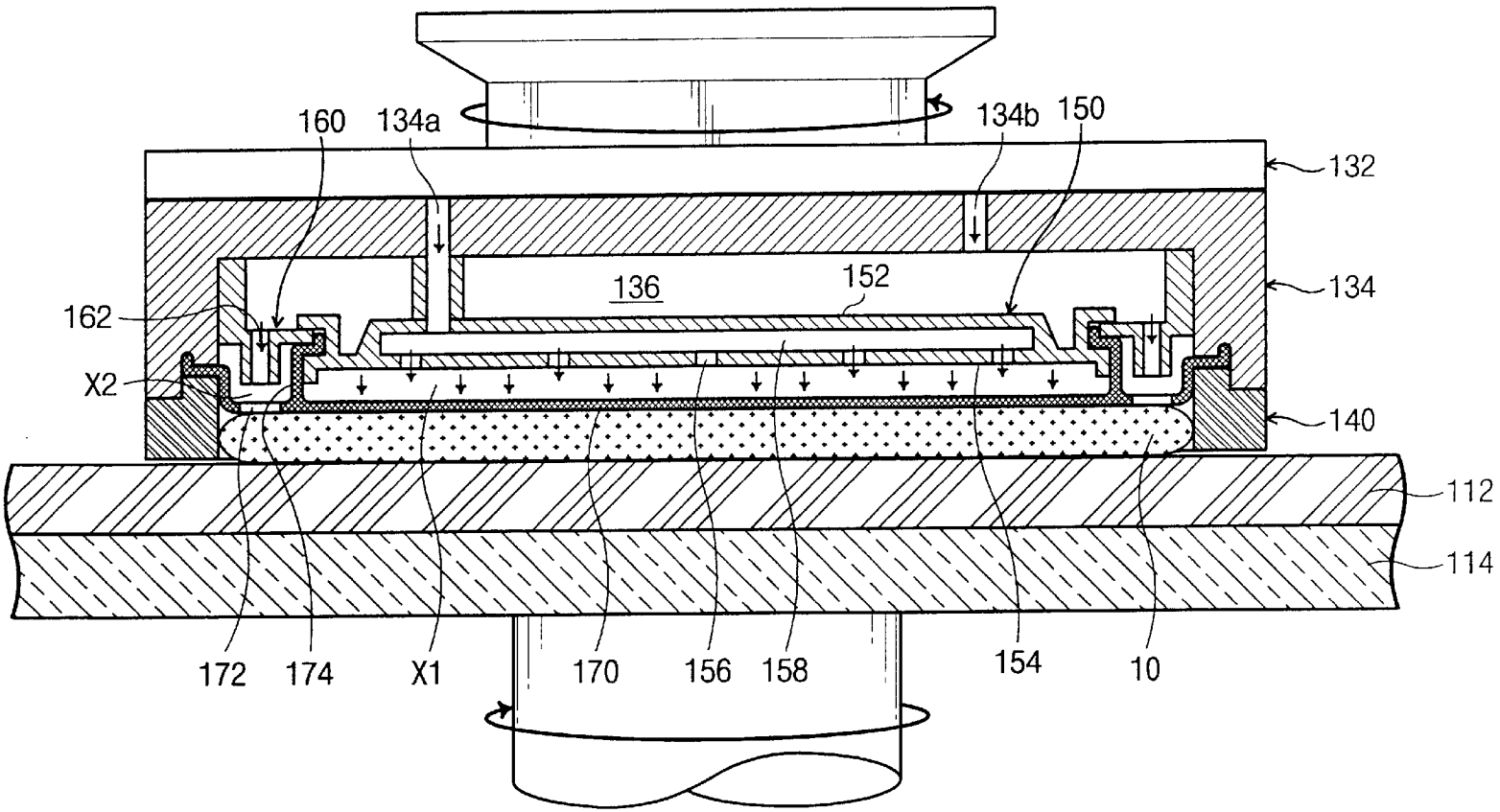

During the polishing step of FIG. 6B, first and second independently controllable pressures are applied to the first and second chambers 158 and 136. The pressure applied through the first and second holes 156 and 162 expands the membrane 170, pressing a first region X1 (formed by a supporter and a membrane) and a second region X2 (formed by a chucking ring and the membrane) of the membrane against the polishing pad 112. The applied pressure operates as a load on a polishing surface of the wafer 10 corresponding to the regions X1 and X2. Slurry is provided through slurry providing means, and the polishing head 130 and the turntable 114 are rotated in opposite directions relative to each other, or alternatively in identical directions, to polish the surface of the wafer. The pressure supplied through each of the gas gates 134*a* and 134*b* is controlled to readily adjust the load applied to the surface of a wafer corresponding to the first and second regions X1 and X2 of the membrane 170.

Figure 6C:
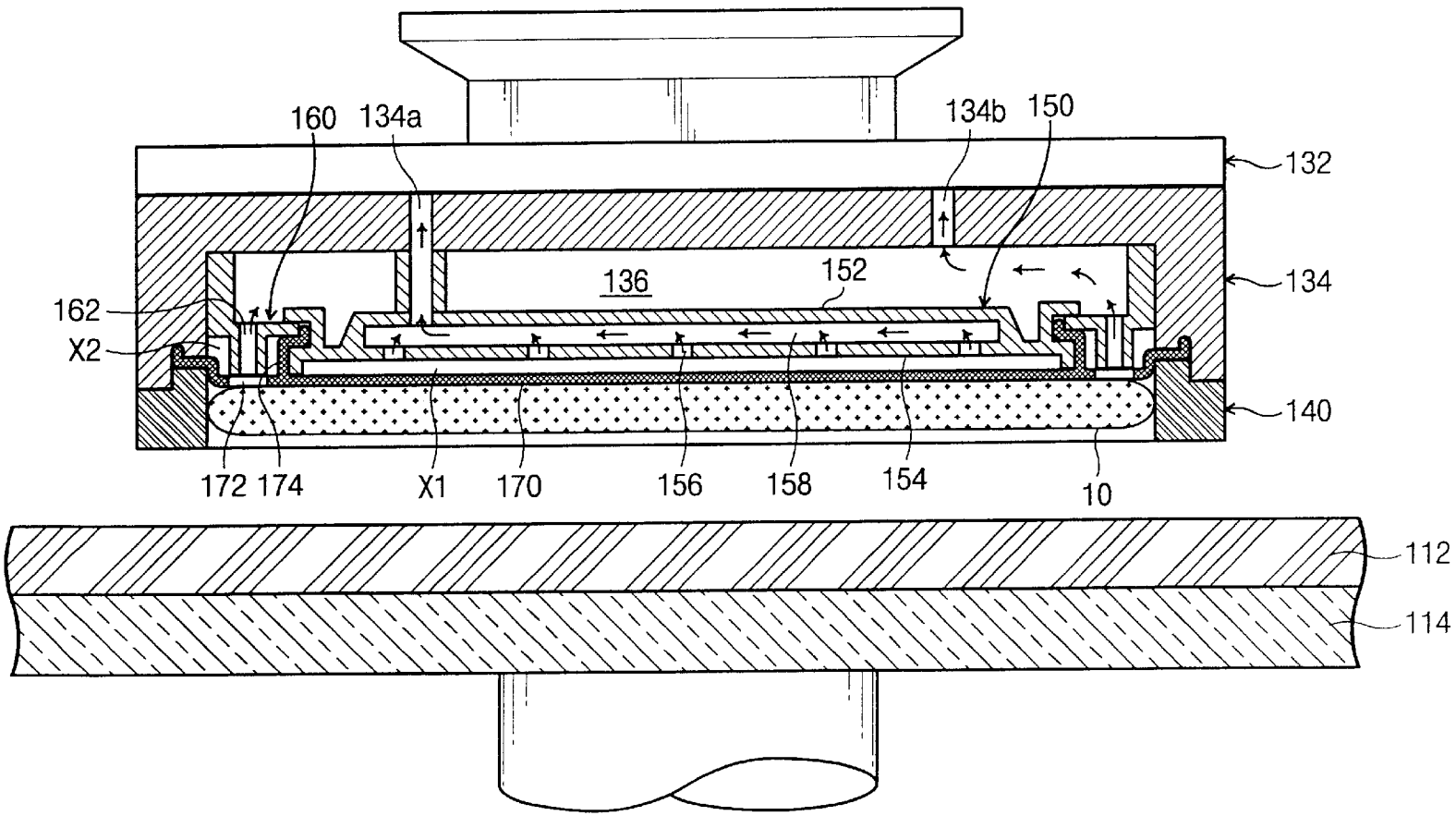

During the chucking step following polishing, a vacuum is provided to the second chamber 136 through the second gas gate 134*b,* as shown in FIG. 6C. Instead of a vacuum, zero pressure (the term "zero" is commonly used at a fabrication site to refer to atmospheric pressure) may alternatively be provided thereto. The wafer 10 is then vacuum-absorbed to vacuum holes 172 that are formed on the second region X2 of the membrane 170. The absorbed wafer 10 is unloaded from the polishing pad 112 to a stand-by stage (not shown), and then is released to the stand-by stage by applying pressure to the membrane 170 via the first and second chambers.

As described above, the polishing head 130 according to the present invention has a membrane that is divided into first and second regions where vacuum and pressure are independently controlled. An independently controllable load is applied to local portions of the wafer, each portion corresponding to the regions, thereby leading to improvement in polishing uniformity and control. Particularly, assuming a higher pressure is applied to the outer, second region X2, of the membrane, polishing uniformity at the outer wafer edge can be improved. The membrane 170 further includes vacuum holes for chucking and releasing a wafer, which helps to avoid loose chucking of the wafer due to vacuum leakage between the membrane and the wafer.

Although the membrane illustrated is partitioned into first and second independently pressurized portions to provide the two regions X1 and X2, the membrane may alternatively be divided into, for example, three portions. Further, it will be understood that pressure can independently be controlled at the various regions.

[Modified First Embodiment]

Figure 7:
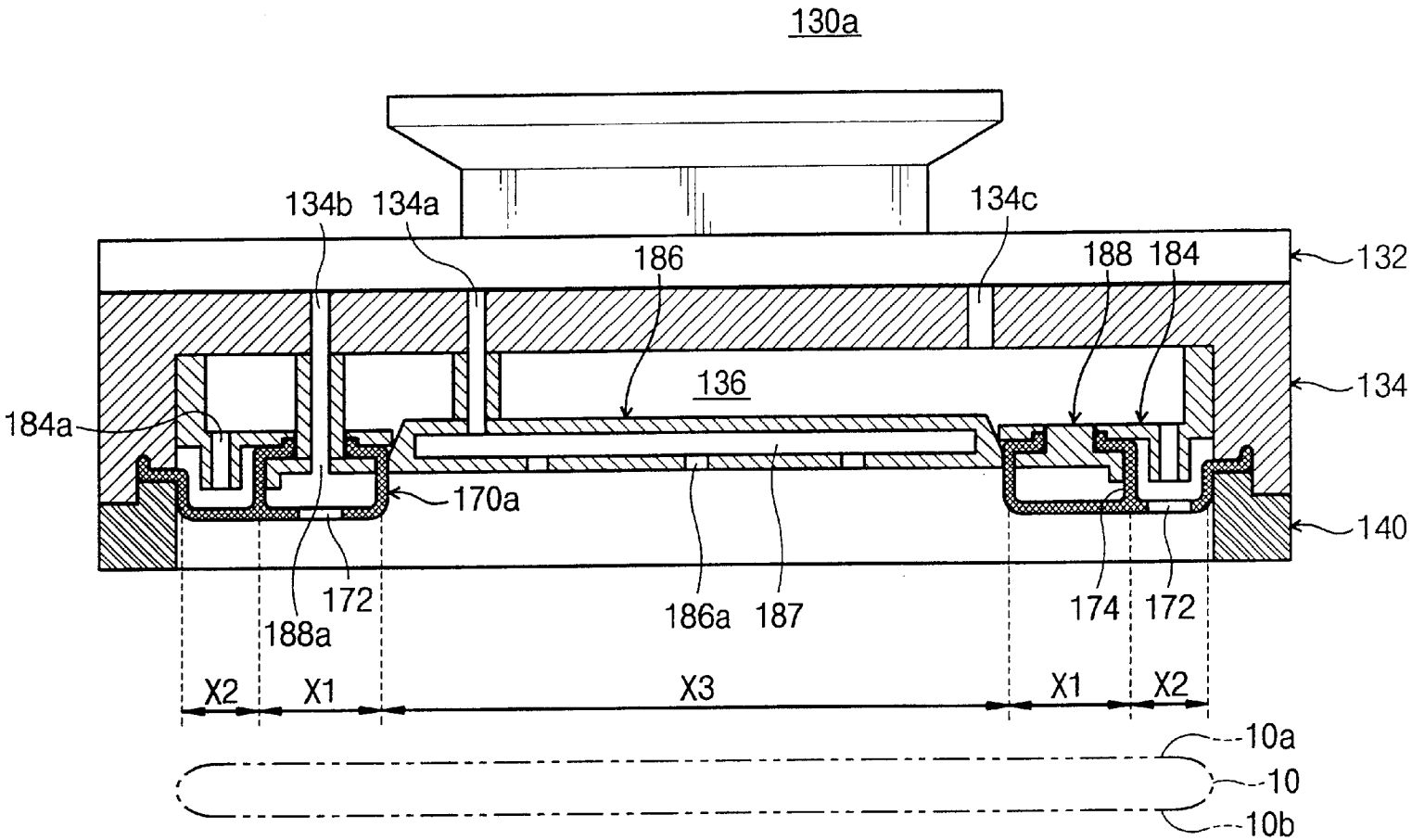
FIG. 7 is a cross-sectional view of a polishing head according to a modified first embodiment of the present invention.
Figure 8:
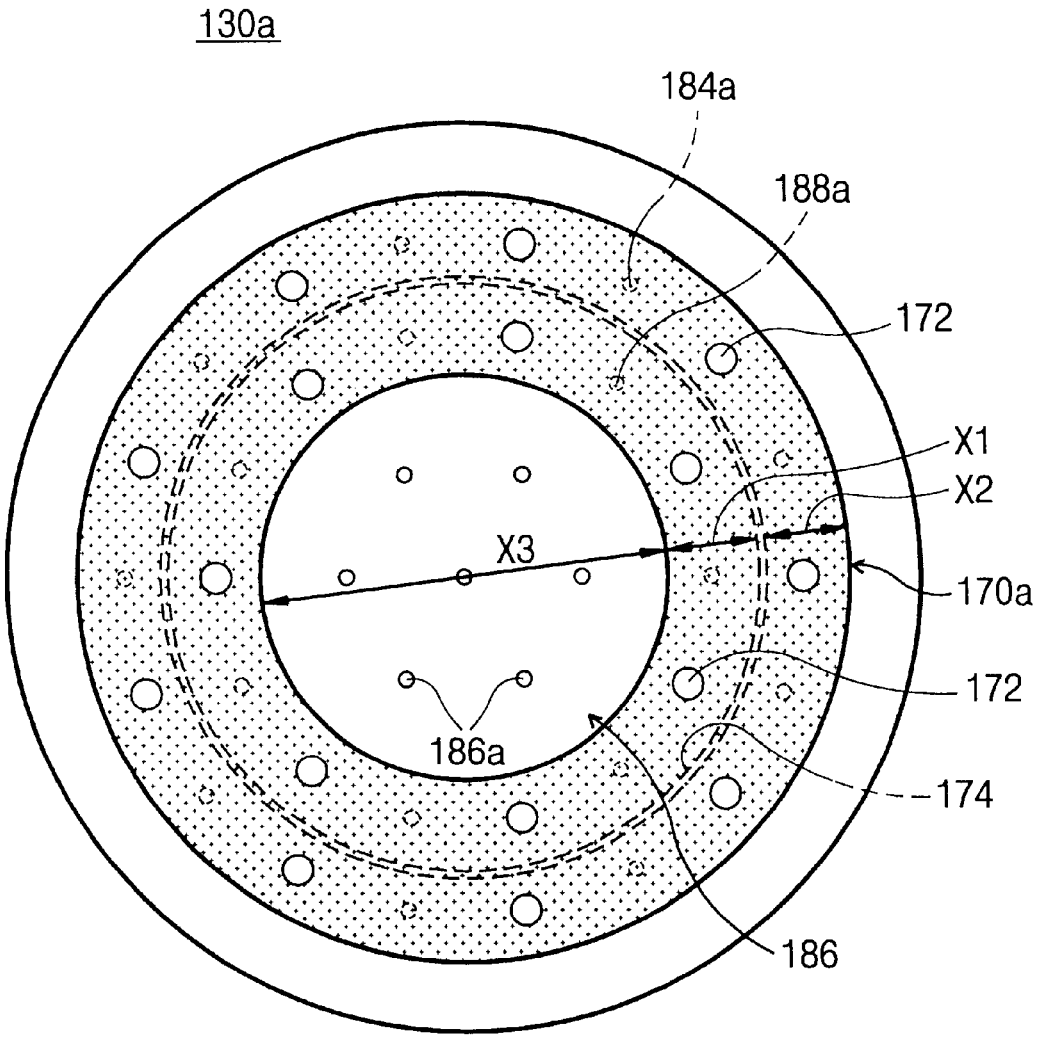
FIG. 8 is a bottom view showing a polishing head shown in FIG. 7.
Figure 9:
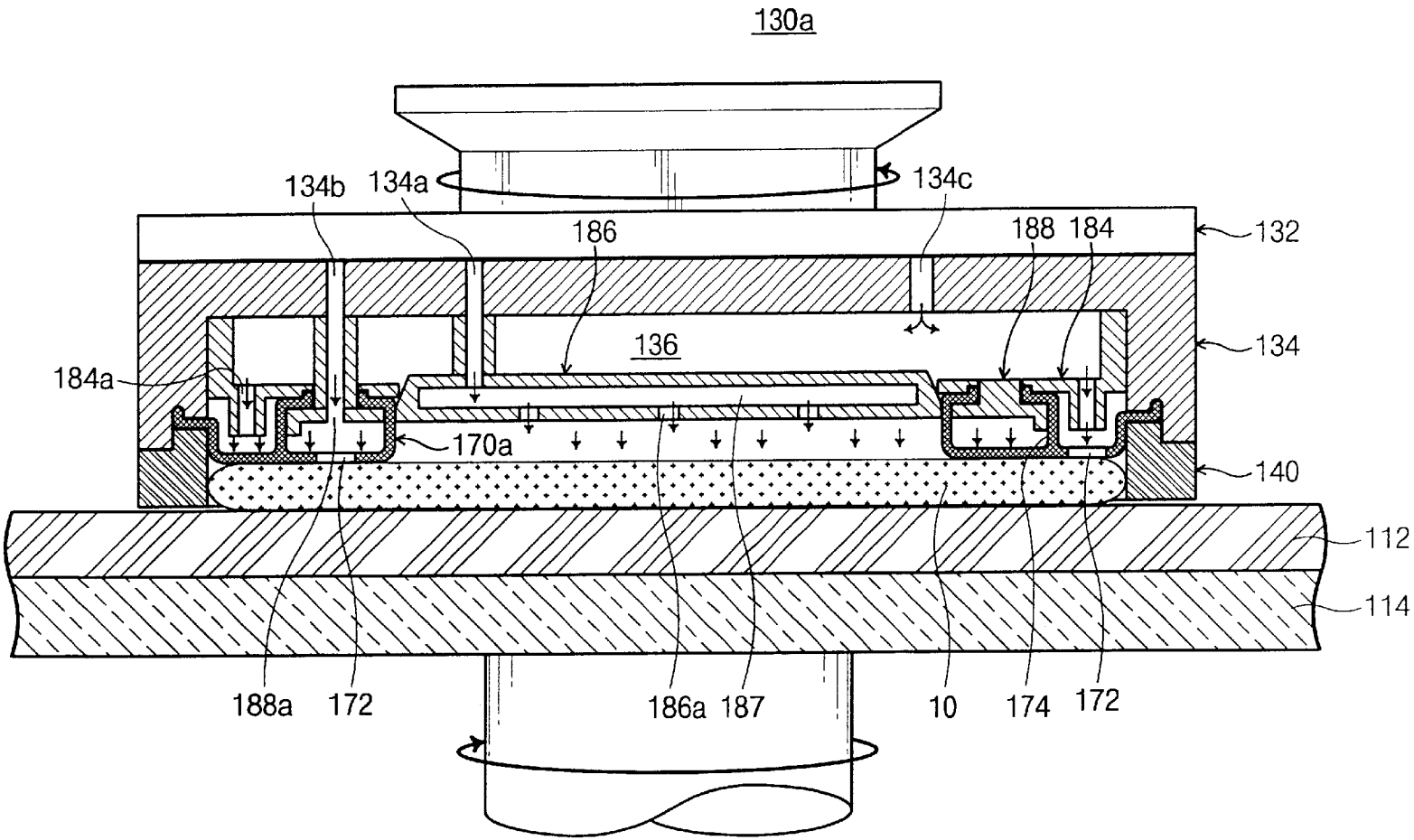
FIG. 9 is a cross-sectional view showing the polishing steps using the polishing head shown in FIG. 7.

FIG. 7, FIG. 8, and FIG. 9 illustrate views of a polishing head 130*a* according to a modified first embodiment of the present invention. The polishing head 130*a* according to the modified first embodiment is nearly identical to a polishing head 130 according to the first embodiment with regard to characteristic structure and operation. The difference lies in that the modified polishing head 130*a* is divided into a plurality of regions X1 and X2 defined by the membrane, and a central region X3 where the membrane is not present. An independently controllable pressure can be provided to each of the regions X1, X2, X3.

The polishing head 130*a* of this embodiment includes a carrier 134, a center supporter 186, a middle supporter 188, a chucking ring 184, and a membrane 170*a*. The carrier 134 includes first, second and third gas gates 134*a,* 134*b,* and 134*c*. The center supporter 186 has a first chamber 187 which communicates with the first gas gate 134*a,* and a bottom portion where first holes 186*a* communicate with the first chamber 187.

The middle supporter 188 is installed in the carrier 134 to be collinear with the center supporter 186, and is positioned at a peripheral side of the center supporter 186. The middle supporter 188 includes a second hole 188*a* which communicates with the second gas gate 134*b*.

The chucking ring 184 is installed in the carrier 184 to be collinear with the middle supporter 188, and is positioned at a peripheral side of the middle supporter 188. The chucking ring 184 provides a third chamber 136 which communicates with the third gas gate 134*c* together with inner walls and center of the carrier 134 and middle supporter 188. The third chamber 136 communicates with a plurality of third holes 184*a* formed at the chucking ring 184.

The membrane 170*a* is annular, and is divided into first and second regions X1 and X2 which enclose sealed volumes together with the middle supporter 188 and the chucking ring 184, respectively. The vacuum and pressure applied to the sealed first and second regions X1 and X2 are independently controllable. The second region X2 is positioned to surround the first region X1 at its perimeter. The membrane 170*a* includes vacuum holes 172 for chucking and releasing a wafer, and a partition wall 174 for dividing the membrane 170*a* into first and second volumes corresponding to the first and second regions. The vacuum holes 172 may be formed in the first and second regions X1 and X2, respectively, or alternatively may be formed only at the first region X1. Vacuum is provided in the central third region X3 in order to chuck the wafer.

The central region X3 is positioned within the annular first region X1. The central region X3 secures a sealed space together with the center supporter 186, the membrane 170*a,* and the upper surface of the wafer 10*a*. With reference to FIG. 9, application of vacuum and pressure may be controlled within the sealed central region X3 through the first gas gate 134*a* independent of the vacuum and pressure of the first and second regions X1 and X2 for chucking and release of the wafer 10.

As described above, the polishing head 130*a* according to the invention is divided into the second region X2, the first region X1, and the central, third region X3 in order to improve wafer polishing uniformity. The first and second regions X1 and X2 include a membrane 170*a,* while the central region X3 is without a membrane. Vacuum and pressure are independently controllable at each of the regions X1, X2, and X3 via the gas gates 134*a,* 134*b,* and 134*c*.

In this manner, it is possible to easily control the load applied to local portions of the wafer, the portions corresponding to the first, second, and third regions. As a result, polishing speed of local portions of the wafer can be controlled with greater precision.

[Second Embodiment]

Figure 10:
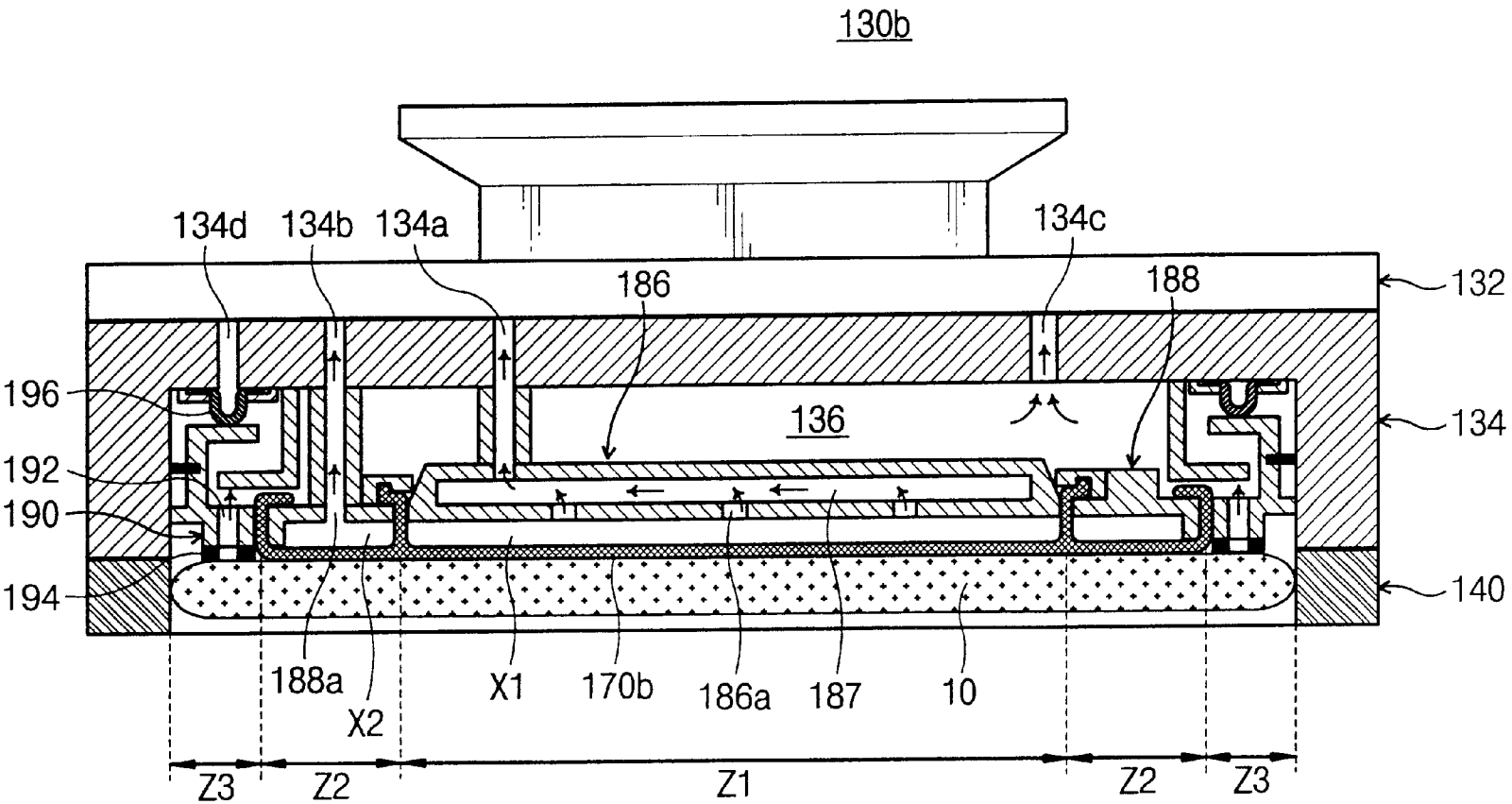
FIG. 10 is a cross-sectional view of a polishing head according to a second embodiment of the present invention.
Figure 11:
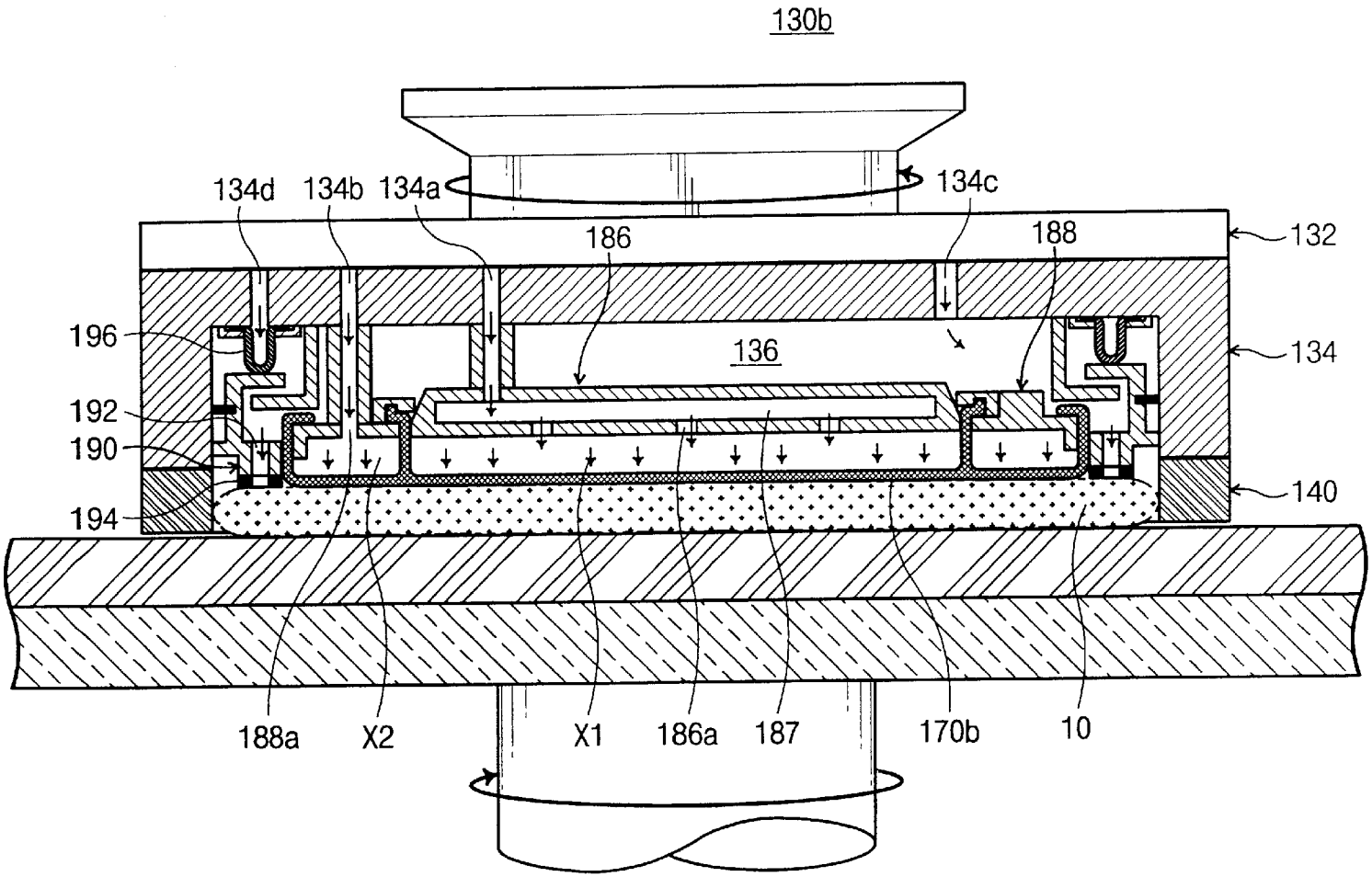
FIG. 11 is a cross-sectional view showing the polishing steps using a polishing head shown in FIG. 10.

FIG. 10 and FIG. 11 illustrate cross-sectional views of a polishing head according to a second embodiment of the present invention.

A polishing head 130*b* according the second embodiment is different from the polishing head 130 according to the first embodiment in that the chucking ring is moved up and down during chucking and polishing. For that reason, the polishing head 130*b* includes a manifold 132, a vessel-shaped carrier 134, a retaining ring 140, a center supporter 186, a middle supporter 188, a membrane 170*b,* a chucking ring 190, and a unit for moving the chucking ring.

The manifold 132 disperses four fluid providing channels to gas gates 134*a,* 134*b,* 134*c,* and 134*d* of the carrier 134. The carrier 134 includes the first, second, third and fourth gas gates 134*a,* 134*b,* 134*c,* and 134*d*. The center supporter 186 is installed in the carrier 134, and includes a first chamber 187 which communicates with the first gas gate 134*a* and a bottom side where first holes 186*a* are formed.

The middle supporter 188 is installed in the carrier 134 to be collinear with the center supporter 186, and is positioned at a peripheral side of the center supporter 186. The middle supporter 188 has a second hole 188*a* that communicates with the second gas gate 134*b*.

The membrane 170*b* is a thin rubber film, the outer face of which directly contacts a rear surface 10*a* of the wafer 10. When pressure is applied to the membrane 170*b*, the membrane 170 is expanded to apply a load to the rear surface 10*a*. The membrane 170*a* is divided into first and second portions X1 and X2 that enclose sealed volumes together with the center supporter 186 and the middle supporter 188, respectively. Vacuum and pressure are independently controllable in the first and second regions X1 and X2. The first region X1 is positioned at a center of the membrane 170*b*, and the second region X2 is positioned about the perimeter of the first space X1. A width of the first region X2 is larger than that of the second region X1.

The chucking ring 190 is installed in the carrier 134 to be collinear with the middle supporter 188, and is positioned at a peripheral side of the middle supporter 188. The chucking ring 190 provides a third chamber 136 that communicates with the third gas gate 134*c* together with inner side and center of the carrier 134 and middle supporters. The chucking ring 190 further includes a vacuum hole 192 for directly vacuum-absorbing the wafer 10. Films 194 for preventing the chucking ring 190 from scratching the wafer 10 are attached about the vacuum hole 192 on the bottom side of the chucking ring 190. The films 194 are used as a wafer loading/unloading medium, and are able to provide a strong load to a wafer edge portion. Although not shown in the drawing, a membrane may cover the chucking ring 190 that is movable in an up and down direction.

The means for moving the chucking ring is installed between the carrier 134 and the chucking ring 190, and includes an elastic member 196 that is pressed and expanded by an applied pressure provided from the exterior (the fourth gas gate 134*d*) to provide a downward load to the chucking ring during polishing. Furthermore, the elastic member 196 is reduced and expanded by a pressure provided through the fourth gas gate 134*d* to effectively serve as a mechanical buffer during wafer chucking.

Although single membrane is installed for both the center supporter and the middle supporter to provide two independent regions in this embodiment, a plurality of membranes can be installed to a single supporter to provide a plurality of regions. Gas gates for independently controlling pressure in the regions may communicate with each of the regions.

As described above, a polishing head according to this embodiment has a special chucking ring for directly vacuum-absorbing a wafer, and moves the chucking ring up and down to directly apply a load to the wafer edge portion.

As described in the first embodiment, a wafer polishing procedure in the CMP apparatus according to the second embodiment includes the steps of loading a wafer 10 vacuum-absorbed to a polishing head 130*b* on a polishing pad 112 of a turntable, applying a pressure to the inside portion of the membrane 170*b* to polish a polishing surface (second surface) of a wafer 10, vacuum-reabsorbing the polished wafer 10 to the polishing head 130*b* using the chucking ring, and unloading the vacuum-reabsorbed wafer 10 from the polishing pad of the turntable.

FIG. 11 illustrates the polishing steps in which an independently controllable pressure is applied to first and second regions X1 and X2 of the membrane and an elastic member 196 through gas gates 134*a*, 134*b*, and 134*d* of a carrier 134. The pressure which is provided to the first region X1 of the membrane through the first gas gate 134*a*, provides a load to a central portion Z1 of a wafer. The pressure which is provided to the elastic member 196 through the fourth gas gate 134*d*, expands the elastic member 196. A chucking ring 190, which is moved down by the expanded elastic member 196, provides a strong load to a wafer edge portion Z3. Slurry is provided by slurry providing means, and then the polishing head 130*b* and turntable 114 are rotated in a direction opposite to each other to polish the wafer surface. The pressure provided to each gas gate is controlled to readily and independently adjust a load applied to each of the portions Z1, Z2, and Z3.

In this embodiment, a pressure provided to gas gates 134*a*, 134*b*, 134*c*, and 134*d* of a carrier 134 is controlled to easily adjust a load applied to local portions (central, middle, and edge portions) of a wafer. Therefore, it is possible to more precisely control the polishing speed of the local portions of the wafer.

Figure 12:
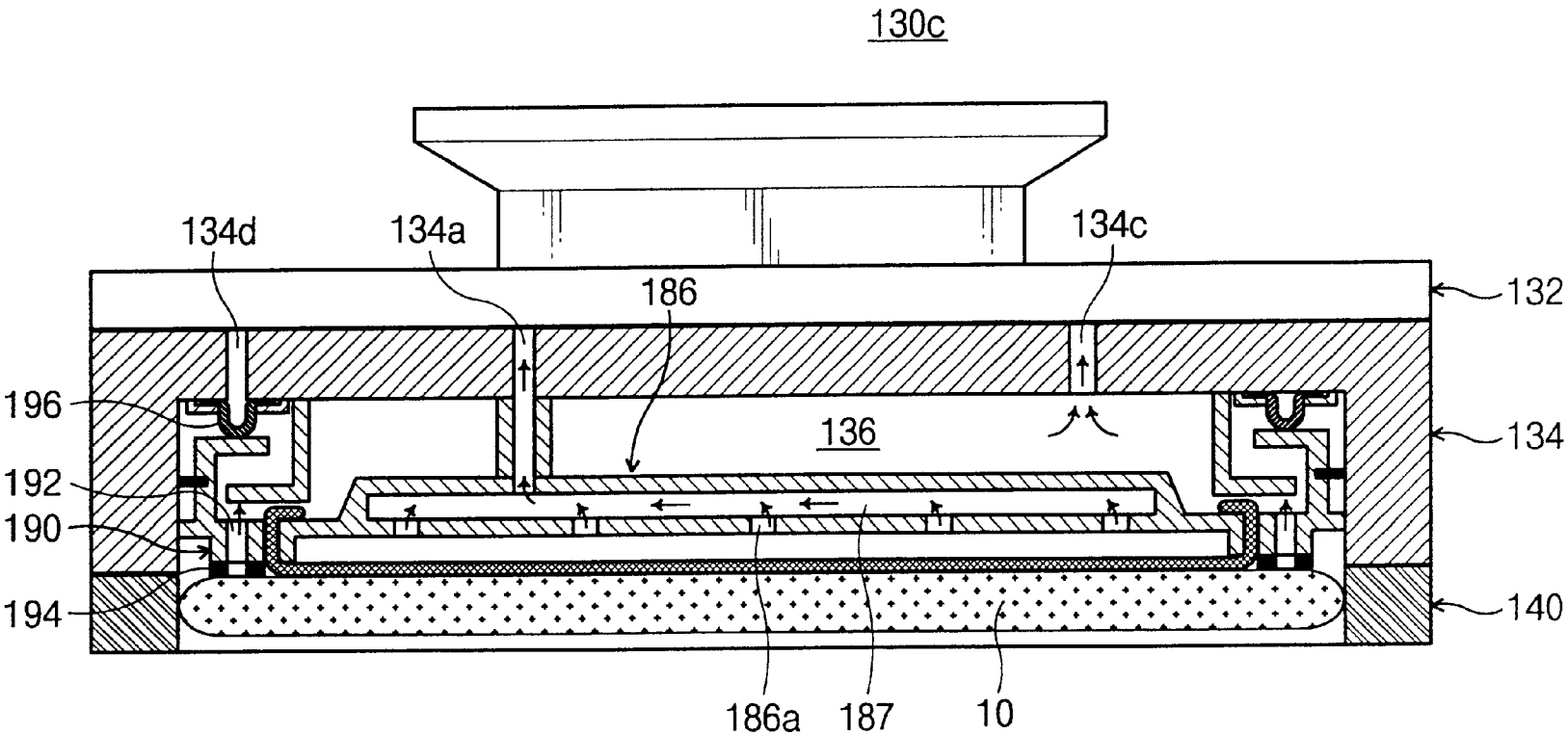
FIG. 12 and FIG. 13 are cross-sectional views of a polishing head according to a modified second embodiment according to the present invention.
Figure 13:
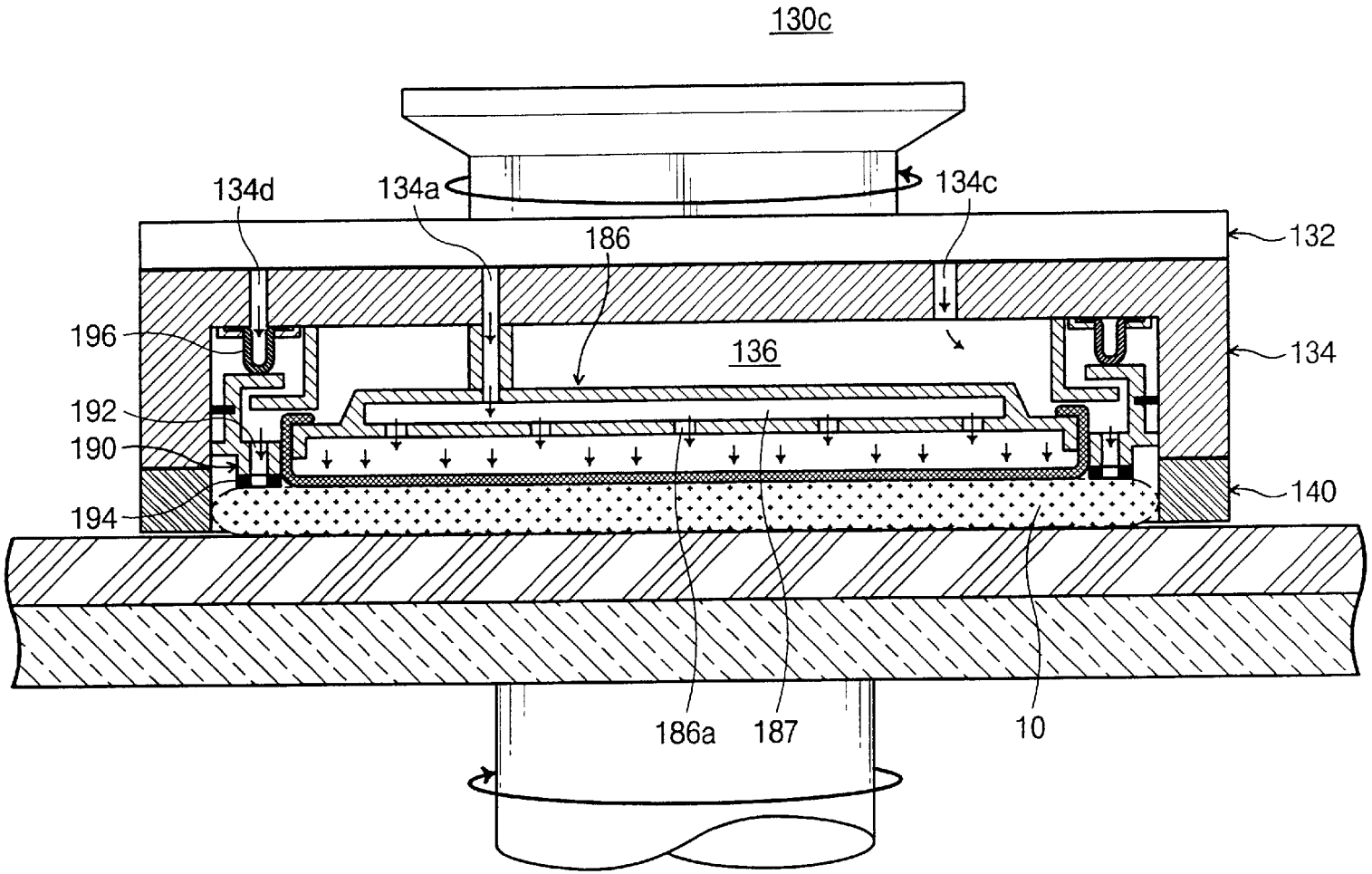

The polishing head of a CMP apparatus according to the second embodiment may alternatively comprise a membrane for providing a single supporter and a single pressurized region, and a polishing head 130*c* having a chucking ring 190 that moves up and down as shown in FIGS. 12 and 13.

The polishing head 130*c* of this embodiment is similar in structure and operation to the head 130 illustrated above with respect to FIGS. 6A–6C, other than the fact that chucking ring 190 moves up and down vertically. Detailed description thereof will therefore be omitted.

While illustrative embodiments of the present invention has been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

What is claimed is:

1. An apparatus for polishing a wafer, comprising:

a base having a polishing pad; and a polishing head comprising a earner and a membrane communicating with the carrier so as to form first and second regions, the polishing head positioned over the polishing pad of the base, wherein the polishing head includes a supporter at an internal central region of the carrier to provide a first chamber corresponding to the first region, and a chucking ring about the supporter in the carrier and collinear with the supporter to provide a second chamber corresponding to the second region; and wherein the membrane covers the supporter and the chucking ring, and wherein the supporter includes first outlets for connecting the first chamber to the first region, and the chucking ring has second outlets for connecting the second chamber to the second region.

2. The apparatus of claim 1, wherein the first chamber communicates with a first fluid passage and wherein the second chamber communicates with a second fluid passage.

3. The apparatus of claim 1, wherein the membrane includes vacuum holes for chucking/releasing a wafer, the vacuum holes corresponding to the second outlets of the chucking ring.

4. The apparatus of claim 1, wherein the first region comprises an annular region about the center of the membrane, and wherein the second region is positioned about the first region.

5. The apparatus of claim 4, wherein a central region is positioned within the annular first region, and wherein an internal pressure of the central region is independent of internal pressure of the first and second regions.

6. The apparatus of claim 1, wherein the membrane divided into the first and second regions is annular.

7. An apparatus for polishing a wafer, comprising:

a base having a polishing pad; and a polishing head comprising a carrier and a membrane communicating with the carrier so as to form first and second regions, the polishing head positioned over the polishing pad of the base, wherein the polishing head includes a supporter at an internal central region of the carrier to provide a first chamber corresponding to the first region, and a chucking ring about the supporter in the carrier and collinear with the supporter to provide a second chamber corresponding to the second region; and wherein the membrane covers the supporter and the chucking ring, wherein the first region comprises an annular region about the center of the membrane, wherein the second region is positioned about the first region, wherein a central region is positioned within the annular first region, and wherein an internal pressure of the central region is independent of internal pressures of the first and second regions.

* * * * *

UNITED STATES PATENT AND TRADEMARK OFFICE

CERTIFICATE OF CORRECTION

PATENT NO. : 6,769,973 B2
DATED : August 3, 2004
INVENTOR(S) : Jae-Phil Boo et al.

It is certified that error appears in the above-identified patent and that said Letters Patent is hereby corrected as shown below:

Column 10,
Line 34, delete “earner” and insert -- carrier --.

Signed and Sealed this

Second Day of November, 2004

JON W. DUDAS
*Director of the United States Patent and Trademark Office*